US006422408B1

(12) United States Patent
Lissandre et al.

(10) Patent No.: US 6,422,408 B1
(45) Date of Patent: Jul. 23, 2002

(54) METHOD AND DEVICE FOR MOUNTING THE MASTHEAD OF TOWER CRANES

(75) Inventors: Michel Lissandre, Izeure; Yves Millet, Moulins, both of (FR)

(73) Assignee: Potain, Ecully (FR)

( * ) Notice: Subject to any disclaimer, the term of this patent is extended or adjusted under 35 U.S.C. 154(b) by 0 days.

(21) Appl. No.: 09/488,569

(22) Filed: Jan. 21, 2000

(30) Foreign Application Priority Data

Jan. 27, 1999 (FR) ..... 99 01114

(51) Int. Cl.[7] ..... B66C 23/70
(52) U.S. Cl. ..... 212/270; 212/178; 212/177
(58) Field of Search ..... 212/175, 177, 212/179, 270, 176, 178

(56) References Cited

U.S. PATENT DOCUMENTS

| | | | | |
|---|---|---|---|---|
| 844,990 | A | * | 2/1907 | Allan et al. |
| 2,049,653 | A | * | 8/1936 | Ljungkull |
| 4,529,094 | A | | 7/1985 | Wadsworth |
| 4,569,453 | A | * | 2/1986 | Oustad ..... 212/191 |

FOREIGN PATENT DOCUMENTS

| | | | |
|---|---|---|---|
| DE | 3307982 | * | 9/1984 |
| DE | 3510116 | * | 10/1985 |
| EP | 0 635 450 A1 | | 1/1995 |
| EP | 0 846 650 A1 | | 6/1998 |
| FR | 2 551 941 A | | 3/1985 |
| GB | 965 025 A | | 7/1964 |

* cited by examiner

*Primary Examiner*—Thomas J. Brahan
(74) *Attorney, Agent, or Firm*—Oliff & Berridge, PLC

(57) ABSTRACT

The invention relates to the mounting of the revolving part of a tower crane, at the top of the mast. A first assembly, formed by the counterjib (8), its tie rod (19) and a rear part (22) of the jib bearer (5), made in two separable parts, is pre-built on the ground, then lifted up and assembled by pinning (at 18) on the revolving pivot or the mast-cab (10) and is held temporarily in place by retaining link rods (48). Another assembly, formed by the jib (6), its tie rods (13, 14) and the front part (21) of the jib bearer, is also pre-built on the ground, then lifted up and assembled by pinning (at 77) on the revolving pivot or the mast-cab (10). The respective tops (28, 47) of the front part (21) and of the rear part (22) of the jib bearer (5) are then joined together by temporary pinning along an axis (78), followed by definitive pinning along an axis (79).

11 Claims, 12 Drawing Sheets

D
47
80
48
22
49
56
54
15
42
53
68
18
55
10
50
69
65
67
66
19
8
70
20
63

76
6
16
14
13
12
40
E
39
40
12
35
36
41
15
82
23
21
34
E
77
F
22
42
48
18
10
19
8
20
15
28
30
47
78
F 76
6
14
16
15
29
79
28
30
47
78
G
13
12
39
40
12
35
37
36
41
H
40
H
J
5
82
23
21
34
77
G
22
42
48
18
10
19
8
20
63
56
10
49
J

R
P
Q
POLAR

POLAR

METHOD AND DEVICE FOR MOUNTING THE MASTHEAD OF TOWER CRANES

BACKGROUND OF THE INVENTION

The present invention relates to a method and a device for mounting the constituent elements of the revolving part of a tower crane, this invention being more particularly intended at the construction and mounting of the masthead of tower cranes.

Heavy-duty cranes used on building and civil engineering work sites are generally "top turning", that is to say have a stationary mast, the height of which can be adjusted by means of additional mast elements, and a revolving top part which can be oriented about a vertical axis and which comprises a delivery jib and a counterjib which constitutes a support for the counterweights.

More specifically, the revolving part of such a crane usually includes a revolving pivot, surmounted by a masthead also known as the "jib bearers", the jib and the counterjib being situated one on each side of the masthead. The jib is articulated by its rear end to the front face of the jib bearer and is held in a roughly horizontal position by means of one or more lines of jib tie rods each obliquely connecting the top of the jib bearer to a point on the jib. Similarly, the counterjib is articulated by its anterior end to the rear face of the jib bearer and is kept in a roughly horizontal position by means of one or more lines of counterjib tie rods each obliquely connecting the top of the jib bearer to a point on the counterjib.

European Patent Application EP 0 635 450 A1, in the name of the Applicant, describes a method for mounting the delivery jib and the counterjib of such a tower crane. According to this method, the jib elements are aligned and assembled on the ground with their tie rods, then the jib tie rods, and possibly those of the counterjib, are raised and aligned using auxiliary lifting gear such as a mobile crane. Next, using the same equipment, the entire jib or counterjib is lifted up with the tie rods, and the jib or counterjib is offered up to the previously mounted masthead so that the free ends of the lines of tie rods are offered up correctly to the top of the masthead, thus allowing the tie rods to be pinned directly to the top of the masthead.

European Patent Application EP 0 846 650 A1 in the name of the Applicant also discloses a method for mounting the tie rods of the jibs of tower cranes, of the kind at issue here, whereby:

- In a first step, the counterjib is joined to the base of the already mounted masthead, the end of the tie rod of the counterjib is joined to a mounting strap attached temporarily to the masthead, the strap is raised using a mounting cable which forms lifting tackle between this strap and the top of the previously mounted masthead until the tie rod is aligned, and the counterjib tie rod is pinned to the top of the masthead.
- In a second step, the same is done with the jib tie rod or rods, that is to say the jib is joined to the base of the masthead, on the opposite side to the counterjib, by pinning, the free end of the jib tie rod or tie rods is or are connected to a mounting strap attached temporarily to the masthead, this strap is lifted up using the aforementioned mounting cable which forms more lifting tackle between said strap and the top of the previously mounted masthead until the tie rod or tie rods, joined together, are aligned, and the jib tie rod or tie rods is or are pinned to the top of the masthead.

This method too is implemented by initially aligning and assembling the jib elements on the ground, and by using auxiliary lifting gear to offer up the counterjib, and then the jib, against the previously mounted masthead.

This solution proves to be more attractive than the one in European Patent Application EP 0 635 450, particularly in the case of heavy-duty tower cranes, the jibs of which have many tie rods. However, it still has certain drawbacks.

In particular, the method according to document EP 0 846 650 A1 requires special motorization, with an auxiliary winch and tackle or with a handwinch and tackle, to align and pin the jib and counterjib tie rods, hence resulting in a certain amount of constructional complication in the device for implementing the method.

Setting up the tackle needed for aligning and pinning the jib and counterjib tie rods also takes time. This method also ties up the auxiliary lifting gear for a relatively lengthy period of time, which lifting gear has to be used not only for the main handling operations but also during the intermediate operations which are lifting up the counterjib tie rods and the jib tie rods using the aforementioned tackle. Finally, the method under consideration requires several manual pinning assembly operations to be carried out "up in the air", at a certain risk to those involved who have to move along those parts of the crane which are being temporarily held by the auxiliary lifting gear.

What is more, this kind of method entails producing the revolving part of the crane as three "packages", namely the "jib" assembly, the "counterjib" assembly and the "jib bearer with tackle" assembly. This requires a significant amount of space for storing and transporting the constituent parts of the revolving part, and also means that the auxiliary lifting gear has to raise the three "packages" in succession.

SUMMARY OF THE INVENTION

The present invention sets out to avoid these drawbacks, and its object is therefore to provide a method and a device for mounting the constituent elements of the revolving part of a tower crane, of the kind in question, which simultaneously allow:

- a reduction in the volume needed for storing and transporting the constituent parts of the revolving part, looking to nest the elements where possible;
- a reduction in the number of components and auxiliary parts specific to the crane mounting operations, particularly by eliminating the tackle and its motorization, which previously were dedicated to these operations;
- a simplification and limitation on the number of operations of assembling the constituent elements of the revolving part done "up in the air", and making these operations more safe for those involved by reducing the number of handling and assembly operations performed "up in the air", particularly by reducing the number of main packages;
- a reduction in the time for which the auxiliary mounting gear, such as the mobile crane, is used.

To that end, the method according to the invention essentially consists, in the case of a tower crane, the revolving part of which comprises a masthead or jib bearer, a delivery jib which is articulated by its posterior end to the front face of the jib bearer and connected to the top of the jib bearer by one or more tie rods, and a counterjib which is articulated by its anterior end to the rear face of the jib bearer and connected to the top of the jib bearer by one or more tie rods:

- in assembling, on the ground, an assembly formed by the counterjib, its tie rod or rods and a rear part of the jib bearer which is made in two separable parts, namely a front part and the rear part, and in also assembling on the ground another assembly formed by the jib, its tie rod or rods and the front part of the jib bearer:

using handling or lifting gear, in lifting up the pre-built assembly formed by the counterjib, its tie rod or rods and the rear part, the jib bearer, and in assembling this assembly, by pinning along a horizontal axis, on the revolving pivot or on a mast or mast-cab element connected to this revolving pivot;

using the handling or lifting gear, in lifting up the pre-built assembly formed by the jib, its tie rod or rods and the front part of the jib bearer, and in assembling this assembly, by pinning along a horizontal axis, on the revolving pivot or the mast-cab;

in using at least one pin to join the respective tops of the front part and the rear part of the jib bearer together.

Thus, the invention is based essentially on initially dividing the jib bearer into two parts, a front part and a rear part respectively, which allows two distinct assemblies to be pre-built on the ground, one of these assemblies comprising the counterjib and the rear part of the jib bearer, and the other comprising the jib and the front part of the jib bearer. These two pre-built assemblies are then lifted up in turn and assembled to the revolving pivot or to the top of the mast-cab by pinning. The two constituent parts of the jib bearer are also joined together by pinning, in their upper portions, so as finally to form a complete, rigid jib bearer of triangular or polygonal appearance (when viewed from the side).

Advantageously, the assembling on the ground of the assembly formed by the jib, its tie rod or rods and the front part of the jib bearer is performed by connecting the base of the front part of the jib bearer to the posterior end of the jib root in an articulated manner and by also connecting the front part of the jib bearer to the jib root by a means which restricts the forward and backward pivoting of the front part of the jib bearer relative to the jib. The angular travel thus allowed, for example of the order of 5°, makes the final operation of connecting the tops of the front part and the rear part of the jib bearer easier.

In one particular embodiment, the operation of assembling on the ground the assembly formed by the jib, its tie rod or rods and the front part of the jib bearer also comprises, for the or each tie rod of the jib, attaching a rear part of the tie rod to the top of the front part of the jib bearer, attaching a front part of that same tie rod to an intermediate point of the jib, bringing the rear part and the front part of the tie rod closer together using a sling pulled by auxiliary handling or lifting gear, and pinning the front end of the rear part of the tie rod to the rear end of the front part of the tie rod. The tie rods are thus pinned together by operations performed on the ground, and are in an aligned position.

The operation of lifting up the assembly formed by the counterjib, its tie rod or rods and the rear part of the jib bearer can be performed, according to a first embodiment, using slings comprising front slings secured to the base of the rear part of the jib bearer and passing over a deflecting member borne by this rear part, and rear slings secured to the structure of the counterjib so as to keep the structure of the counterjib roughly horizontal while this assembly is being lifted and pinned to the revolving pivot or the mast-cab, the tie rod or rods of the counterjib being aligned and taut.

In another embodiment which is an alternative form of the previous one, the operation of lifting up the assembly formed by the counterjib, its tie rod or rods and the rear part of the jib bearer is performed using slings comprising front slings secured to the base of the rear part of the jib bearer, but which are not deflected in any way, and rear slings secured to the structure of the counterjib, the slings being of an appropriate length to keep the structure of the counterjib in an inclined position with respect to the horizontal while this assembly is being lifted and pinned to the revolving pivot or the mast-cab, the rear part of the counterjib being pivoted backward in such a way that the tie rod or rods remain slack: the counterjib structure is brought back to the horizontal and the tie rod or rods are tensioned after said assembly has been pinned to the revolving pivot or the mast-cab.

Given that the assembly comprising the counterjib and the rear part of the jib bearer is built first of all, then the assembly comprising the jib and the front part of the jib bearer is built, the method also advantageously comprises, after the operation of pinning the first of these assemblies to the revolving pivot or the mast-cab, making a temporary connection, with play, holding the rear part of the jib bearer in an upright position while waiting for the top of the front part of the jib bearer to be pinned to the top of said rear part. This temporary connection with play which is not used when the crane is operating, can be made using retaining link rods and slots connecting the top of the rear part of the jib bearer to the revolving pivot or to the mast-cab.

The operation of lifting the assembly formed by the jib, its tie rod or rods and the front part of the jib bearer is also performed using slings, preferably keeping the jib roughly horizontal until such time as it is pinned to the revolving pivot or the mast-cab, then by pivoting the jib upward slightly about the pin used for this pinning so as to approximately pin, with play, the top of the front part to the top of the rear part of the jib bearer. Next, the jib is pivoted in the opposite direction, bringing the rear part of the jib bearer forward, and definitive pinning is carried out. More specifically, the pivoting of the jib in the opposite direction, which brings the rear part of the jib bearer forward on account of its greater weight, causes the hole for the definitive pinning of the top of said rear part to travel along an arc of a circle, the center of which corresponds to the axis for the pinning of the counterjib and the rear part of the jib bearer to the revolving pivot or the mast-cab. During this same time, the hole for the definitive pinning of the top of the front part of the jib bearer travels along another arc of a circle, the center of which corresponds to the axis of pinning of the jib and of the front part of the jib bearer to the revolving pivot or the mast-cab. Through these movements, the respective holes for the definitive pinning of the tops of the two parts of the jib bearer are sure to find a common axis at the point of intersection of the two arcs of a circle mentioned, regardless of the geometric starting position of these pinning holes, and it is thus always possible to perform definitive pinning. As will be understood, this definitive pinning stiffens the jib bearer as required so that the latter can fulfill its function while the crane is operating.

To implement the mounting method defined previously, another subject of the invention is a device which essentially comprises, in combination:

a front part of a jib bearer, including uprights joined rigidly together and fitted at their lower ends with tangs or yoke, collaborating with yokes or with tangs provided at the posterior end of the jib root and with yokes or tangs provided on the revolving pivot or the mast-cab, a rear part of a jib bearer, separable from the front part and comprising uprights connected rigidly together and fitted at their lower ends with tangs or with yokes, collaborating with yokes or with tangs provided at the anterior end of the structure of the counterjib and with yokes or tangs provided on the revolving pivot or the mast-cab, the front part and the rear part of the jib bearer also being provided, at their respective tops, with complementing members such as tang and yoke so that these two parts can be pinned together.

According to one embodiment of this device, the front part of the jib bearer is connected, by a prop made up of two unequal portions articulated together, to the posterior part of the jib root, one of the portions of the prop including a member for bearing against the mast root so as to limit the forward and backward pivoting of the front part of the jib bearer with respect to the jib.

According to another advantageous provision, the complementing tang and yoke, provided at the tops of the front part and rear part of the jib bearer, have corresponding anterior and posterior holes for, respectively, the approximate pinning, with play, and the definitive pinning of the tang and the yoke.

Overall, the method and the device for mounting the masthead of tower cranes, which are the subject of the invention, have the following advantages over the prior art:

It is no longer necessary to provide motorization (with its power supply) and tackle for aligning and pinning the tie rods of the jib and possibly of the counterjib, hence providing simplification and a saving.

By eliminating the use of tackle for aligning and pinning the jib tie rods, the invention also affords a time saving in the premounting and mounting operations.

Most of the premounting operations, particularly relating to the assembly formed by the jib, its tie rod or rods and the front part of the jib bearer, and the assembly formed by the counterjib, its tie rod or rods and the rear part of the jib bearer, are performed at ground level, and therefore in complete safety, using light-duty handling gear.

Just two "packages", namely, on the one hand, the assembly formed by the jib, its tie rod or rods and the front part of the jib bearer and, on the other hand, the assembly formed by the counterjib, its tie rod or rods and the rear part of the jib bearer, need to be handled in succession by heavy-duty lifting gear (instead of the three "packages" in the solutions of the prior art).

The operations of handling these two assemblies, using the heavy-duty lifting gear, are performed directly one after the other, without it being necessary, between these operations, to perform other intermediate operations such as lifting the jib and counterjib tie rods; the time for which the heavy-duty lifting gear is tied up is thus minimized.

All the pinning operations which still have to be performed "up in the air" are performed vertically in line with the mast of the crane, and therefore without risk to those involved who, in particular, do not have to move around at height along parts of the crane which are held only by the lifting gear.

Being made of two separable parts, each of roughly planar shape, the jib bearer takes up a minimum amount of space for transportation and storage.

This two-part structure of the jib bearer also makes it easier to manufacture, avoiding any volumic mechanical fastening assembly, each part being a simple planar lattice with two uprights connected by cross-members.

The connection between the posterior end of the jib, the base of the front part of the jib bearer and the top of the mast-cab is at a single point, more particularly along the same axis of pinning, thus allowing simple triangulation and thereby avoiding all internal bending moments (couples).

Likewise, the connection between the anterior end of the counterjib, the base of the rear part of the jib bearer and the top of the mast-cab is at a single point, more particularly along the same axis of pinning, thus allowing simple triangulation and thereby avoiding all internal bending moments (couples).

BRIEF DESCRIPTION OF THE DRAWINGS

The invention will in any case be better understood with the aid of the description which follows, with reference to the appended diagrammatic drawing which, by way of examples, illustrates some embodiments of this method for mounting the masthead of tower cranes and depicts some embodiments of the device for implementing this method.

DETAILED DESCRIPTION OF PREFERRED EMBODIMENTS

Certain figures have enlarged details denoted by the letters A, B, C, etc.

Figure 1:
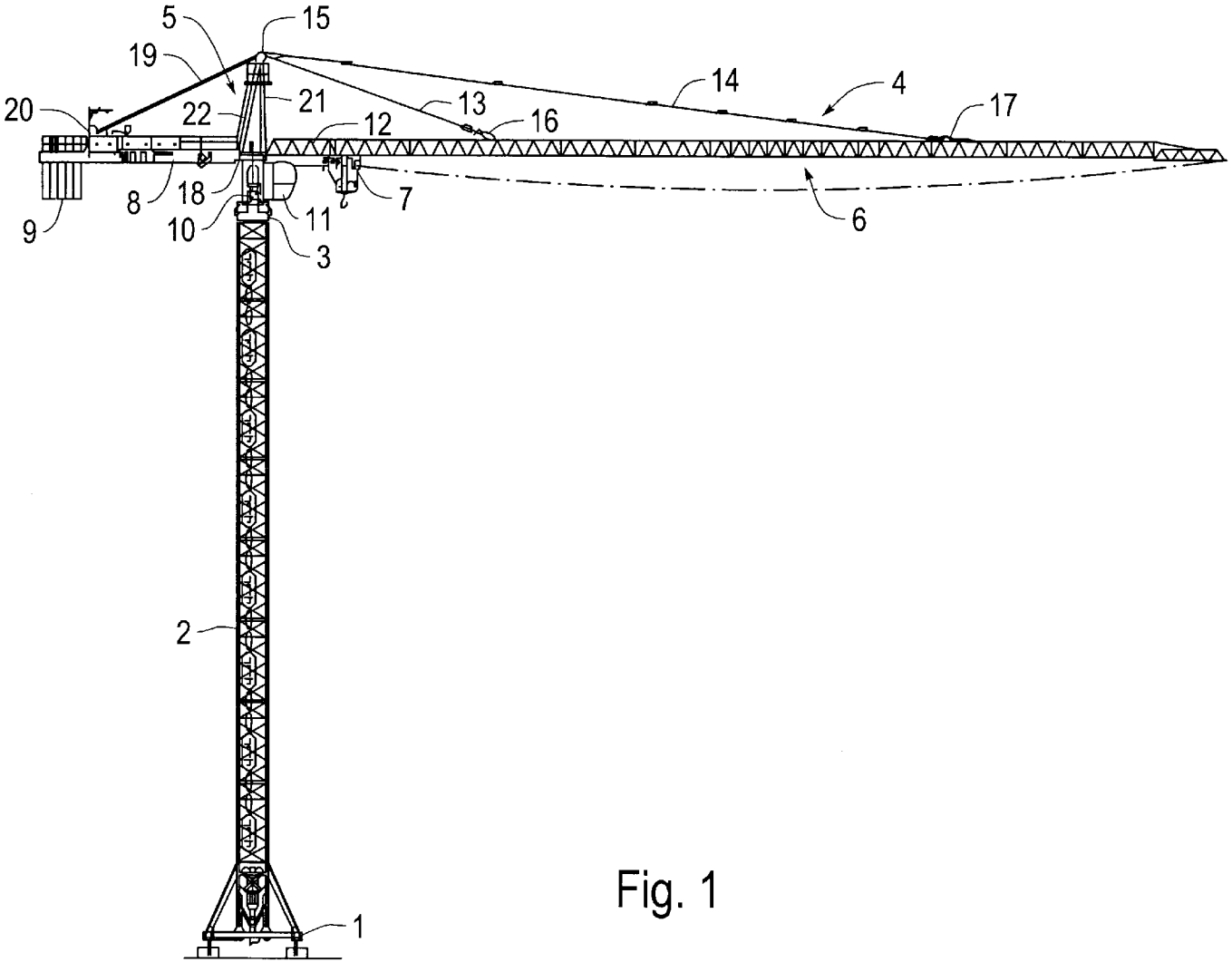
FIG. 1 is an overall side view, in the erected state, of a tower crane to which the method of the present invention applies.

The tower crane depicted in FIG. 1 comprises, in the known way, a stationary or travelling base chassis 1, an adjustable-height mast 2 surmounted by a stationary pivot 3 and a revolving part 4 which can be oriented about a vertical axis and which itself comprises a masthead or "jib bearer" 5, a delivery jib 6 along which a crab 7 travels, and a counterjib 8 bearing a counterweight 9. In the example considered, the jib bearer 5 sits atop a short portion of mast 10, known as the "mast-cab", which also belongs to the revolving part 4 and to the side of which the crane driver's cab 11 is attached.

In a way also known per se, the jib 6 is made up of several aligned elements, in a latticework structure, including a first so-called "jib root" element 12 which is articulated by its posterior end to the base of the jib bearer 5 and to the mast-cab 10, about a horizontal axis. The jib 6 is held in a roughly horizontal position by two oblique tie rods 13 and 14 both connected to the top 15 of the jib bearer 5 and also respectively connected to two intermediate points 16 and 17 (spaced apart) on the jib 6. The tie rods 13 and 14 are themselves each formed of several successive elements articulated together, and may thus also be known as "lines of tie rods".

The counterjib 8 is located, with respect to the masthead 5, on the opposite side to the jib 6, the anterior end of the counterjib 8 being articulated about a horizontal axis 18 to the base of the jib bearer 5 and to the mast-cab 10. This counter jib 8 is here kept in a roughly horizontal position by a double oblique tie rod 19 which connects two symmetric points 20 of the posterior part of the structure of the counterjib 8 to the top 15 of the jib bearer 5. Like the jib tie rods 13 and 14, the counterjib tie rods 19 are made up of several successive elements articulated together. The counterjib 8 also has a latticework structure (see FIG. 2).

Figure 2:
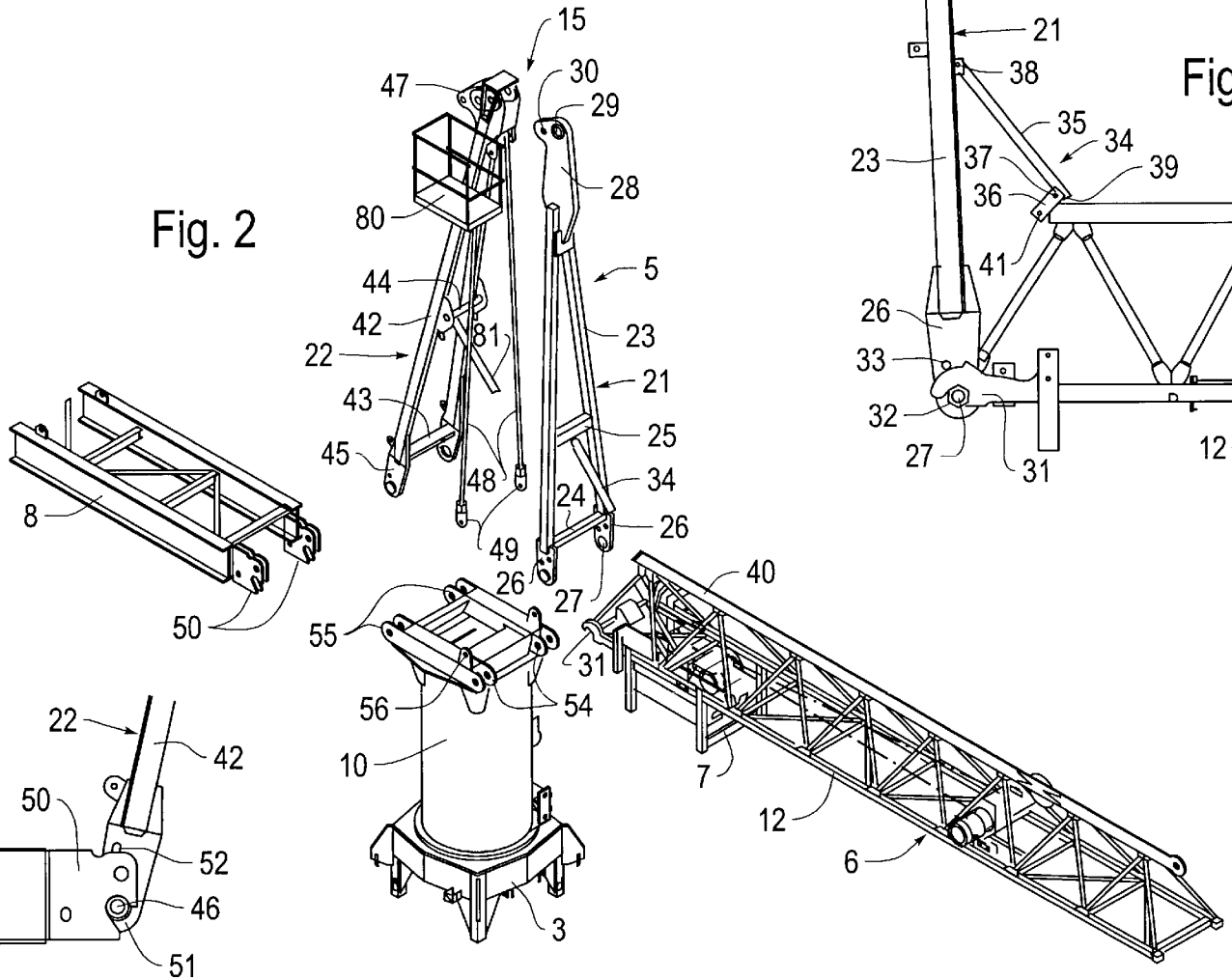
FIG. 2 is an exploded perspective view of the masthead and of the adjacent parts, particularly of the jib and counterjib.

The jib bearer 5 consists of two parts which are removable and separable from each other, namely a front part 21 and a rear part 22 depicted separated from one another in FIG. 2. In the assembled position, the front part 21 and rear part 22 converge at the top 15 of the jib bearer 5.

The front part 21 of the jib bearer 5 is associated with the jib 6 and, more particularly, with the jib root 12. This front part 21 comprises two converging uprights 23 joined together at their top and connected together, respectively, at their base and at an intermediate height, by two horizontal cross-members 24 and 25. The lower ends of the two uprights 23 comprise respective tangs 26, each pierced with a pinning hole 27. The close-together upper ends of the two uprights 23 are assembled another tang 28 with pierced with two holes 29 and 30, one being an anterior hole and the other a posterior hole.

The posterior end of the jib root 12 includes, on each side, a yoke 31, the opening of which faces downward, which takes one of the lower tangs 26 of the front part 21 of the jib bearer 5. A boss 32 on each of these tangs 26, and a safety pin 33 (see detail in FIG. 3) prevent each yoke 31 from uncoupling from the corresponding tang 26.

Figure 3:
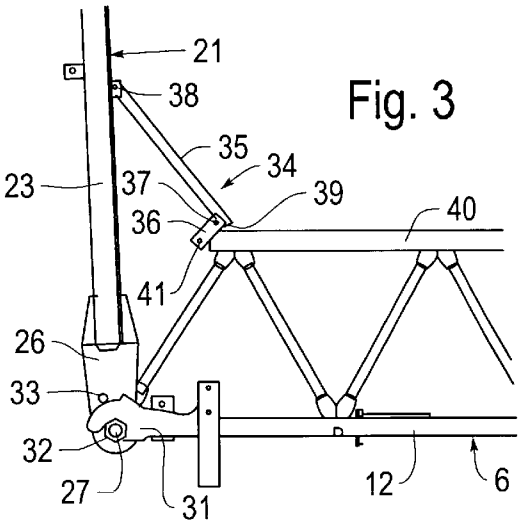
FIG. 3 is a detail view, from the side, of the rear part of the jib root and of a lower portion of the front part of the jib bearer.

With further reference to FIGS. 2 and 3, the front part 21 of the jib bearer 5 is also connected to the jib root 12 by a prop 34 consisting of two unequal portions 35 and 36 which are articulated to one another about an intermediate axis 37. The first portion 35, which is the longer, is articulated by one end to a yoke 38 connected to the cross-member 25 of the front part 21 of the jib bearer 5; at its opposite end, it his a bearing plate 39 intended to rest on the upper member 40 of the jib root 12. The second portion 36, which is the shorter, is articulated about an axis 41 to the posterior end of the upper member 40 of the jib root 12. In FIG. 3, the prop 34 is depicted in the folded position, in which position it limits the forward pivoting of the front part 21, of the jib bearer 5. In the unfolded position, the same prop 34 limits the backward pivoting of the front part 21 of the jib bearer 5. The angle between the two limit positions of this front part 21 of the jib bearer 5 is of the order of 5°.

The rear part 22 of the jib bearer 5 is associated with the counterjib 8. This rear part 22 comprises two converging main uprights 42, joined together at their top and connected together, respectively, at their base and at an intermediate height, by two horizontal cross-members 43 and 44. The lower ends of the two uprights 42 comprise respective tangs 45, each pierced with an opening 46. The close-together upper ends of the two uprights 42 are assembled with a yoke 47, each branch of which has two drillings, one an anterior one and the other a posterior one. The rear part 22 of the jib bearer 5 also comprises two retaining link rods 48, articulated by their upper ends, under the yoke 47. The lower end of each link rod 48 bears a yoke 49.

Figure 4:
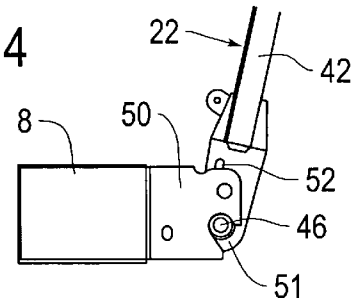
FIG. 4 is a detail view, from the side, of the front end of the counterjib and of a lower portion of the rear part of the jib bearer.

The anterior end of the counterjib 8 includes, on each side, a yoke 50 with the opening facing downward, which takes one of the lower tangs 45 of the rear part 22 of the jib bearer 5. A boss 51 on each of these tangs 45, and a safety pin 52, prevent each yoke 45 from uncoupling from the corresponding tang 45—see FIGS. 2 and 4.

In a particular embodiment (see FIG. 10), the rear part 22 of the jib bearer 5 comprises a strap 53 articulated to the main uprights 42 and designed to offset the point of attachment of the handling slings, as detailed hereinafter.

Optionally, the rear part 22 of the jib bearer 5 comprises at least one connecting bar 81, articulated to the cross-member 44. This bar is attached to the front part 21 of the jib bearer, once the crane has been filly assembled, and acts as a triangulation bar strengthening the connection between the front part 21 and rear part 22 of the jib bearer 5.

Referring once again to FIG. 2, the mast-cab 10 comprises, at its top, two yokes 54 which are located respectively on the two sides of the mast-cab and face forward, two other yokes 55 located respectively on the two sides of the mast-cab and which face backward, and two lugs 56 located respectively on the two sides of the mast-cab and facing upward. The two front yokes 54 of the mast-cab 10 are designed to take the lower tangs 26 of the front part 21 of the jib bearer 5, and the posterior yokes 31 of the jib root 12. The two rear yokes 55 of the mast-cab 10 are intended to take the lower tangs 45 of the rear part 22 of the jib bearer 5, and the anterior yokes 50 of the counterjib 8. Finally, the two lugs 56 of the mast-cab 10, each pierced with a slot, are intended to take the lower yokes 49 of the retaining link rods 48 of the rear part 22 of the jib bearer 5.

Figure 5:
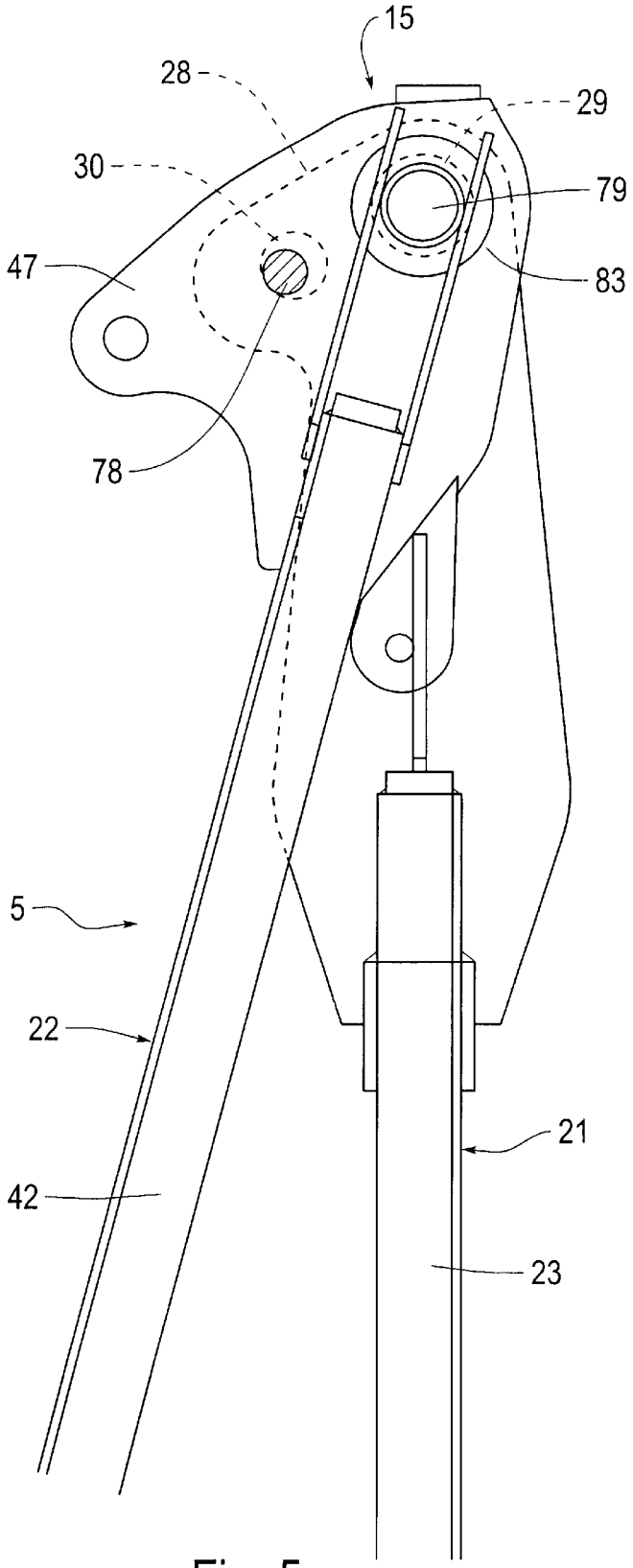
FIG. 5 is a detail view, from the side, of the upper portions of the front part and the rear part of the jib bearer, joined together.

It will also be noted that in the definitively assembled condition, the upper yoke 47 of the rear part 22 of the jib bearer 5 takes the upper tang 28 of the front part 21 of the same jib bearer, the nesting of these two elements being illustrated in FIG. 5 which depicts the region of the top 15 of the masthead.

The procedure followed for mounting the tower crane will now be described.

A first step consists in assembling on the ground the elements of the counterjib 8 and the associated parts, using light-duty handling equipment (maximum load less than or equal to 4 tonnes, for example). The elements of the double tie rod 19 of the counterjib 8 are then put in place, as is the rear part 22 of the jib bearer 5, so as to form a structure of triangular appearance formed of the counterjib 8, the double tie rod 19 and said rear part 22.

A second step consists in assembling on the ground the elements of the jib 6 and the associated parts, still using the light duty handling equipment. The successive elements of the jib 6 are aligned and assembled with one another and the crab 7 is also fitted. The front part 21 of the jib bearer is brought, with its prop 34 folded and resting, by its bearing plate 39, on the upper member 40 of the jib root 12—see FIG. 6. The two lines of tie rods 13 and 14 of the jib 8 are also installed: the rear parts 13*a* or 14*a* of these tie rods 13 and 14 are joined by a double link rod 82 which catches over a boss 83 formed around the anterior hole 29 in the tang 28 located at the top of the front part 21 of the jib bearer (see FIG. 5), the double link rod 82 being held in the caught position by a clamping member. The front part 13*b* or 14*b* of each tie rod 13 or 14, still separate from the rear part, is connected at the point 16 or 17 to the top member 40 of the jib 6. As shown by the enlarged details A and B in FIG. 6, for the longer tie rod 14, the front end of the rear part 14*a* has a yoke 57 and the rear end of the front part 14*b* of this tie rod has a tang 58, preferably with a slot, or vice versa. There is also a roller 59 mounted at the front end of the rear part 14*a* of the line of tie rods 14, this roller 59 being able to roll along the top member 40.

Figure 6:
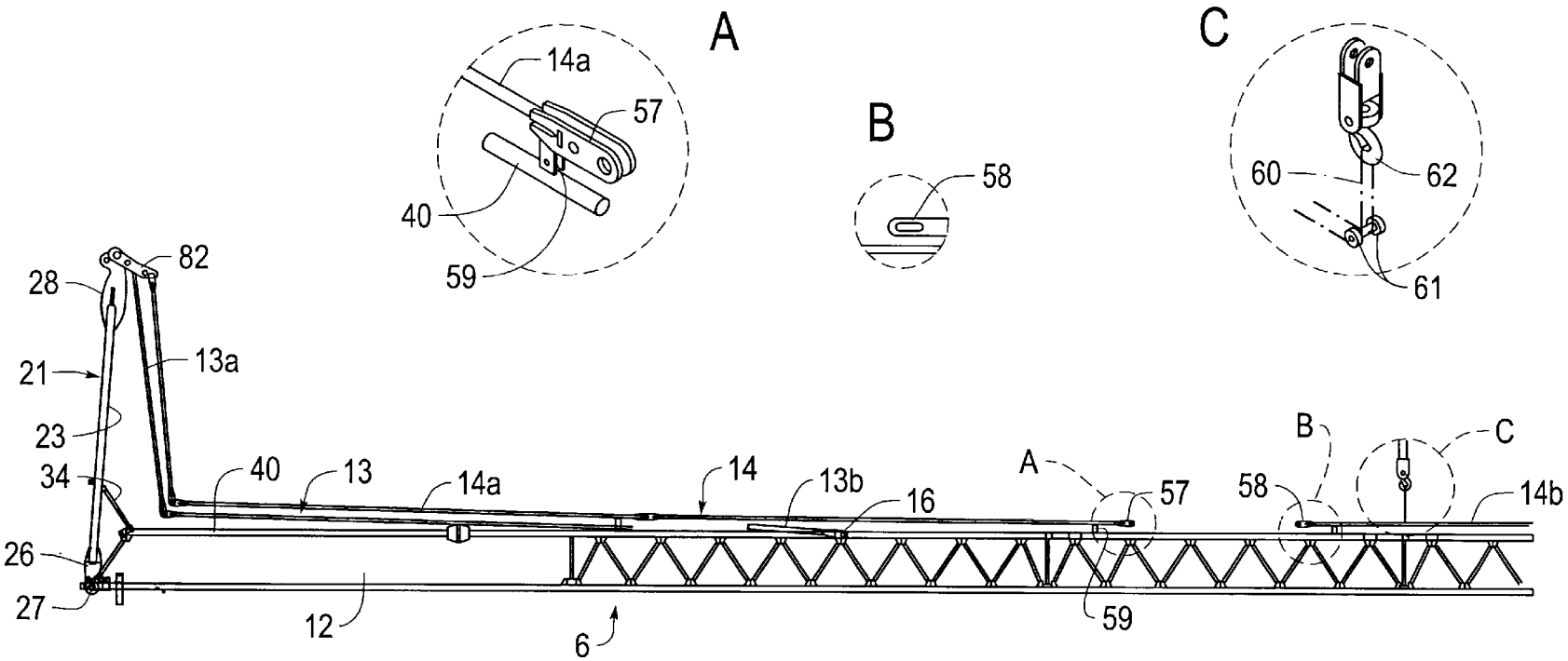
FIG. 6 depicts, viewed from the side, the assembly formed by the jib and its tie rods (depicted partially) and by the front part of the jib bearer, in the initial phase of assembly on the ground.

To bring the two parts of each tie rod 13 or 14 of the jib 6 closer together, use is made of a sling 60 passing over two moveable pulleys 61, and over the hook 62 of the aforementioned handling gear—see detail C in FIG. 6.

Figure 7:
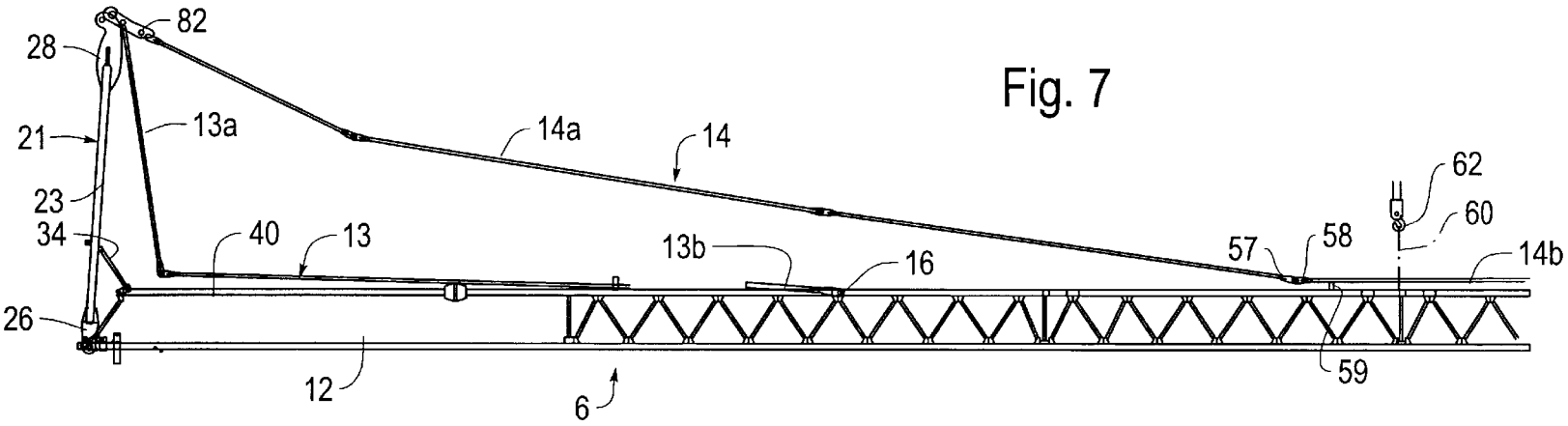
FIGS. 7 and 8 are side views similar to FIG. 6, illustrating two later phases of assembling said assembly on the ground.

Using the sling 60, the two parts 14*a* and 14*b* of the line of upper tie rods 14, which is the longer one, are first of all brought closer together and these parts are pinned together by a pin connecting the yoke 57 to the tang 58, and the slot of which leaves an amount of play—see FIG. 7.

Figure 8:
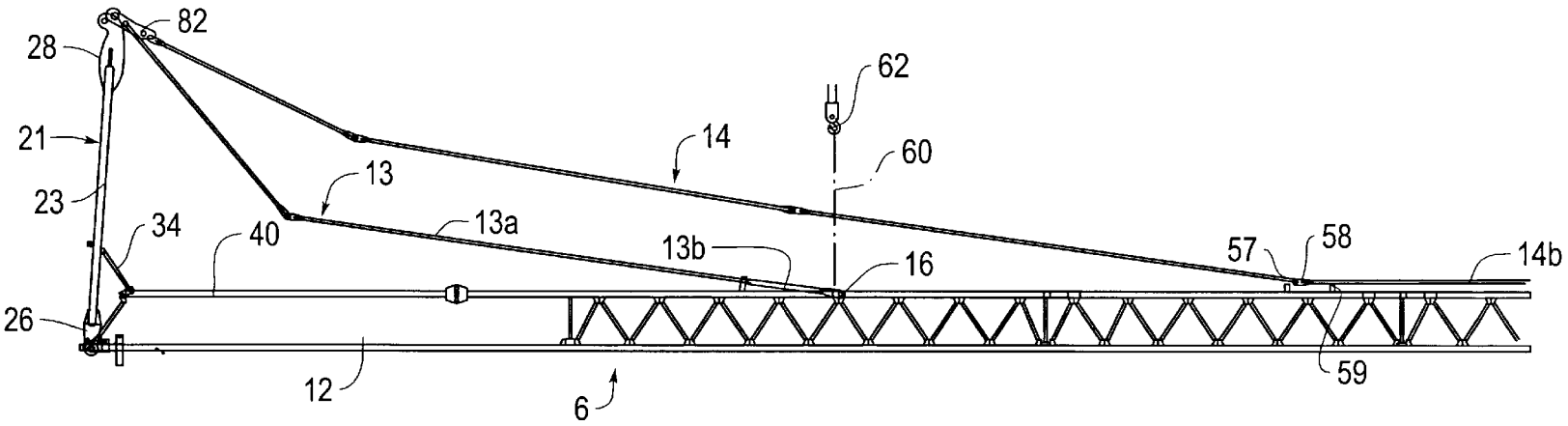

Using the same sling 60 and the same moveable pulleys 61, the two parts 13*a* and 13*b* of the lower line of tie rods 13, which is the shorter one, are then brought closer together, these two parts also finally being pinned together—see FIG. 8.

All the operations described hitherto are perforated on the ground.

Figures 9, 10:
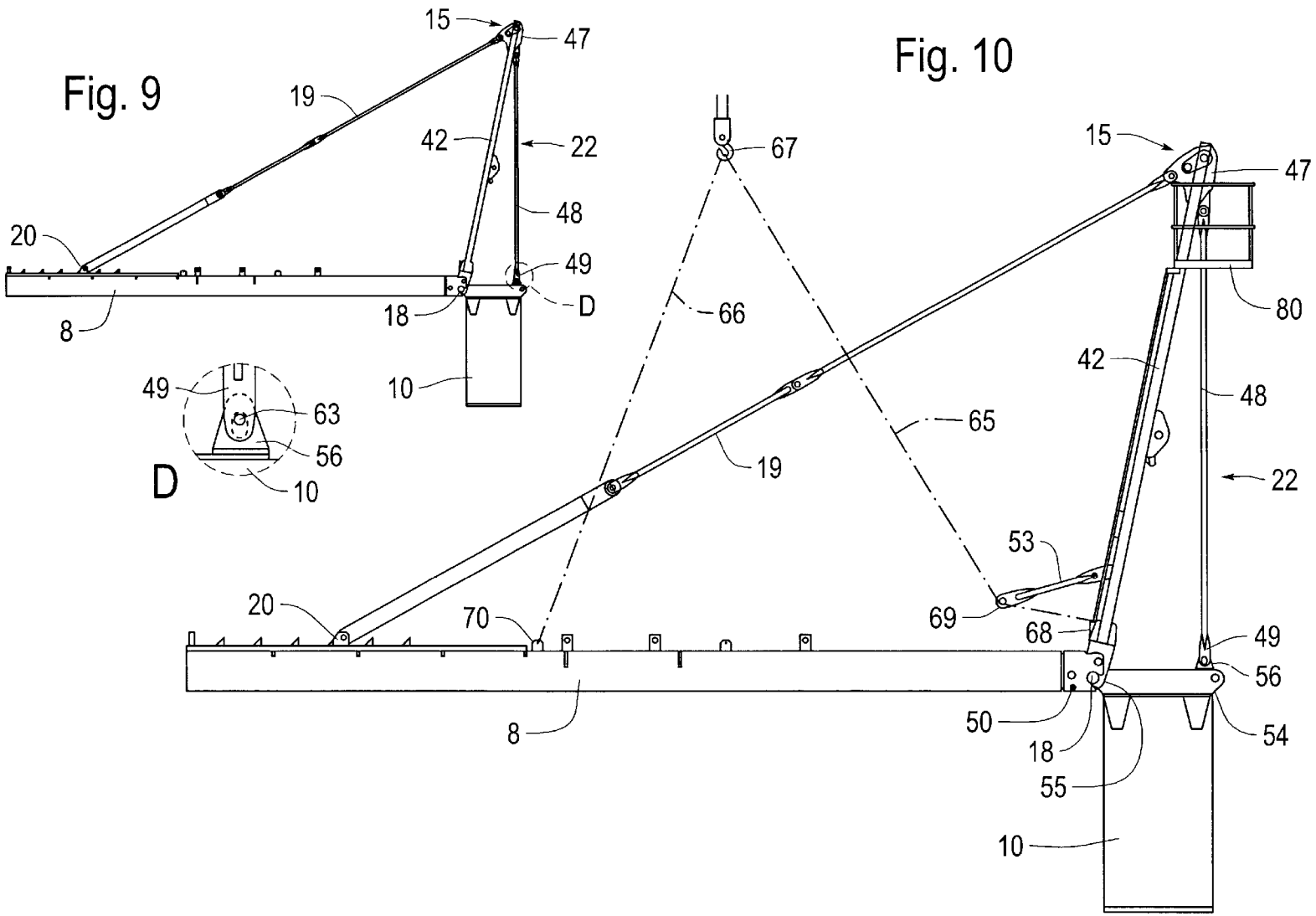
FIG. 9 is a side view illustrating, in principle, the mounting on the mast-cab of the assembly formed by the countcrib, its tie rods and the rear part of the jib bearer.
FIG. 10 depicts, in greater detail, the operation of FIG. 9, particularly from the point of view of the handling of said assembly, in a first implementation embodiment.

The next step consists, using the heavy duty lifting gear (maximum working load for example equal to or greater than 10 tonnes) and, using appropriate slings, in handling the assembly formed by the counterjib 8, the double tie rod 19 and the rear part 22 of the jib bearer 5 to lift this assembly and bring it onto the mast-cab 10, as illustrated in general by FIG. 9.

The anterior end of the counterjib 8 and the base of the rear part 22 of the jib bearer 5 are then pinned to the mast-cab 10 along the horizontal axis 18. As detail D in FIG. 9 shows, a pin 63 is, also used to pin the yokes 49 located at the lower ends of the two retaining link rods 48 of the rear part 22 of the jib bearer 5 to the corresponding lugs 56 of the upper part of the mast-cab 10. This connection having vertical play, by virtue of the slot 64 formed in each lug 56, the assembly thus fitted is finally released backward by pivoting about the axis 18, using the lifting gear used, until the pin 63 comes into abutment against one end of the slot 64.

This step can be carried out, in a first implementation embodiment illustrated in FIG. 10, using a set of special-purpose slings made up of two front slings 65 and two rear slings 66, of predefined length, suspended from the same hook 67 of the lifting gear. The two front slings 65 are attached at a point 68, at the base of the rear part 22 of the jib bearer 5, and pass over the deployed strap 53 so as to be deflected over the end 69 of this strap 53 which thus constitutes an offset fastening point. The two rear slings 66 are attached at symmetric points 70 located toward the rear of the counterjib structure 8. When the assembly is being lifted, the double tie rod 19 of the counterjib 8 is aligned and taut, and the structure of the counterjib 8 remains in a roughly horizontal position, which position is maintained during the (above-described) operations of pinning this assembly to the mast-cab 10.

Figure 11:
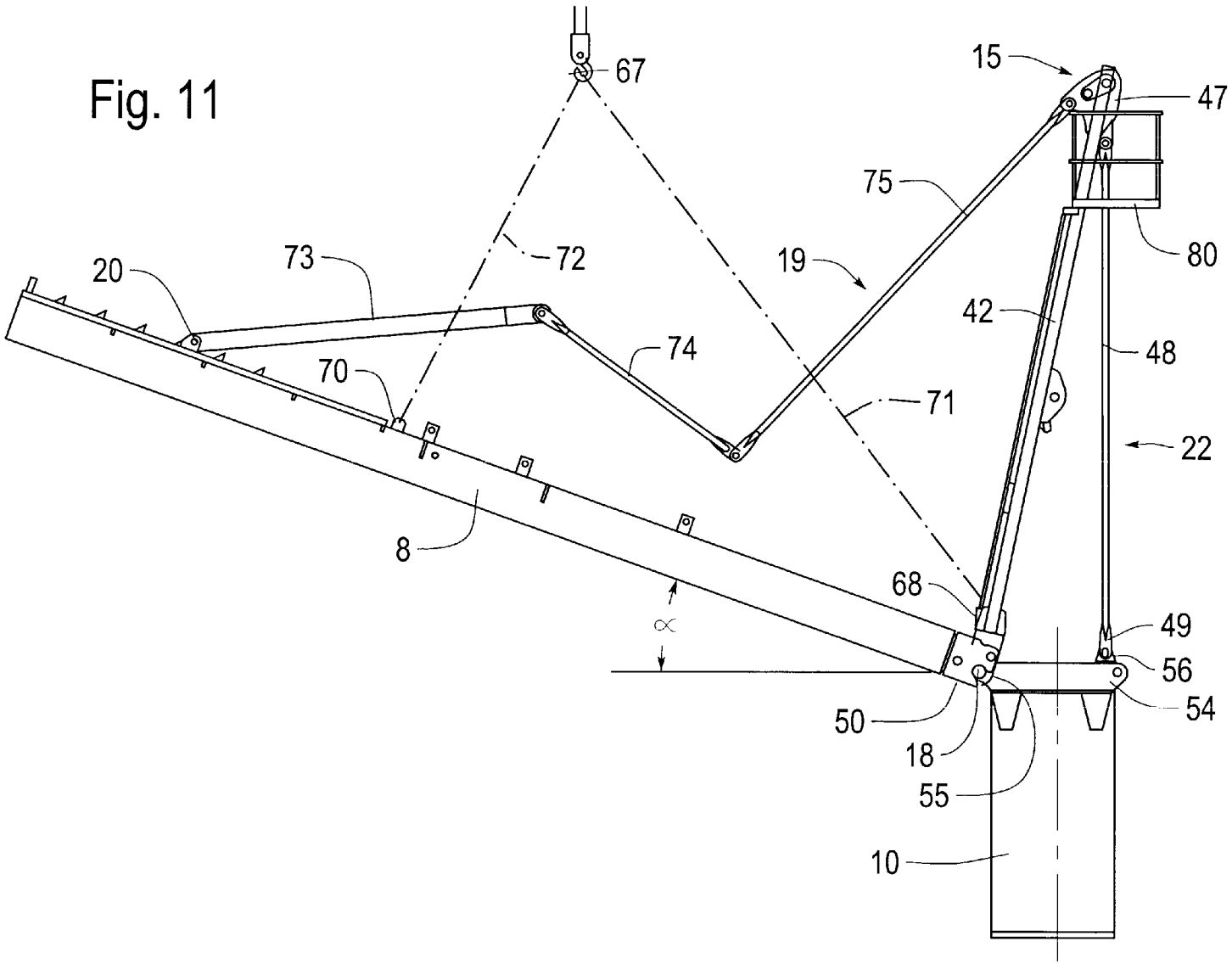
FIG. 11 is a view similar to FIG. 10, illustrating a second implementation embodiment for the handling of said assembly.

According to a second implementation embodiment illustrated in FIG. 11, the assembly in question is handled using another set of special-purpose slings, again made up of two front slings 71 and two rear slings 72, of predefined length. The two front slings 71 are attached to the point 68 at the base of the rear part 22 of the jib bearer 5 and in this case are not deflected in any way between the hook 67 and the fastening point 68. The two rear slings 72 are secured to the points 70 situated toward the rear of the structure of the counterjib 8. When the assembly is being lifted, the two front slings 71 keep the rear part 22 of the jib bearer 5 pivoted backward with respect to the structure of the counterjib 8, in a position of abutment against the yoke 50 by the pin 52, so that the elements 73, 74 and 75 of the line of tie rods 19 form a broken line. The structure of the counterjib 8 is handled forming, with respect to the horizontal, a fairly large angle $\alpha$, for example one equal to or greater than 15°. This inclination of the counterjib 8 is maintained during the (previously defined) operations of pinning the assembly to the mast-cab 10. Once this pinning has been performed, the counterjib 8 is pivoted about the pin 18 which pins it to the mast-cab 10 until it comes into a roughly horizontal position, the elements 73, 74 and 75 of the double tie rod 19 thus being aligned and tensioned.

Figure 12:
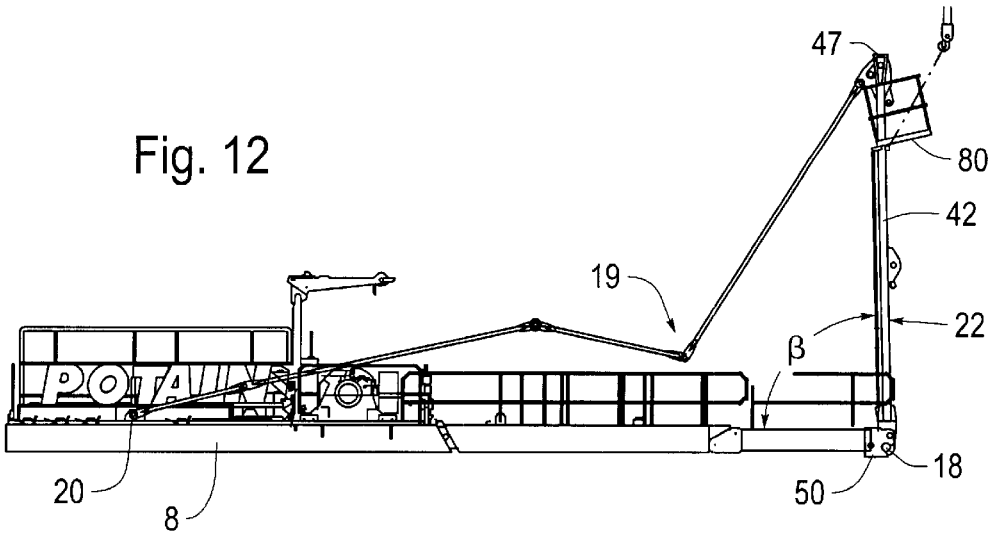
FIGS. 12, 13 end 14 illustrate the successive phases of a third embodiment for assembling this assembly and implementation embodiment for handling it.
Figure 13:
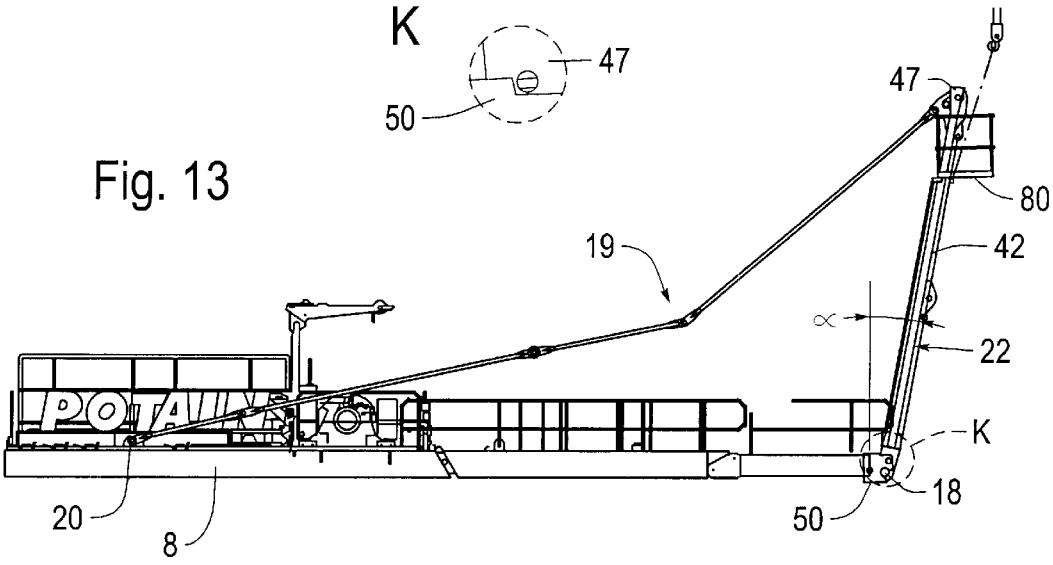
Figure 14:
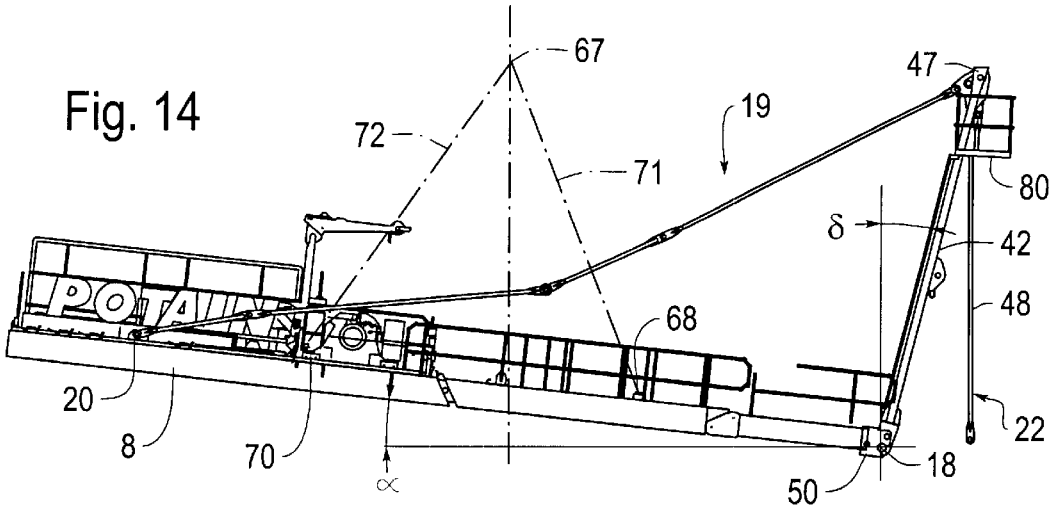

FIGS. 12 to 14 illustrate a third implementation embodiment regarding the assembly and handling of the assembly formed by the counterjib 8, the tie rod or rods 19 and the rear part 22 of the jib bearer 1.

FIG. 12 illustrates the operation of pinning the tie rods 19, performed on the ground. For this operation, the rear part 22 of the jib bearer 5 is set in place in its articulation at the front of the structure of the counterjib 8 and held in a roughly vertical position (fox example with a slight backward inclination, the angle B being about 87°), using the light duty handling gear. The or each line of tie rods 19 is or are then pinned.

Next, as shown in FIG. 13, the same handling gear is used to tilt the rear part 22 of the jib bearer 5 forward into a forward-inclined position (the angle y being equal for example to about 9°). In it tilts, the rear part 22 of the jib bearer 5 takes with it the tie rods 19 which are thus "pre-tensioned". This tilted position of the rear part 22 of the jib bearer 5 is maintained by a rear stop, fitted at the articulation, to keep the pre-tension in the tie rod or rods 19—see detail K in FIG. 13.

Next, using the heavy duty lifting gear and front sling 71 and rear sling 72 of common length, the respective securing points 68 and 70 of which are located on the structure of the counterjib 8, the assembly is lifted up as shown in FIG. 14. The distribution of weight then causes the counterjib 8 to adopt an angle of inclination $\alpha$ of the order of 6° with respect to the horizontal (the rear part 22 of the jib bearer 5 inclining itself forward by an angle $\delta$ equal to about 15°).

As before, this last embodiment makes any member for deflecting the slings 71 and 72 unnecessary. What is more, the angle $\alpha$ of inclination of the counterjib, of the order of 6°, is safer here than the angle of 15° or more reached in the previous embodiment. This smaller angle $\alpha$ avoids introducing horizontal loadings into the masthead and the mast 2 when dismantling the counterjib 8.

Figure 15:
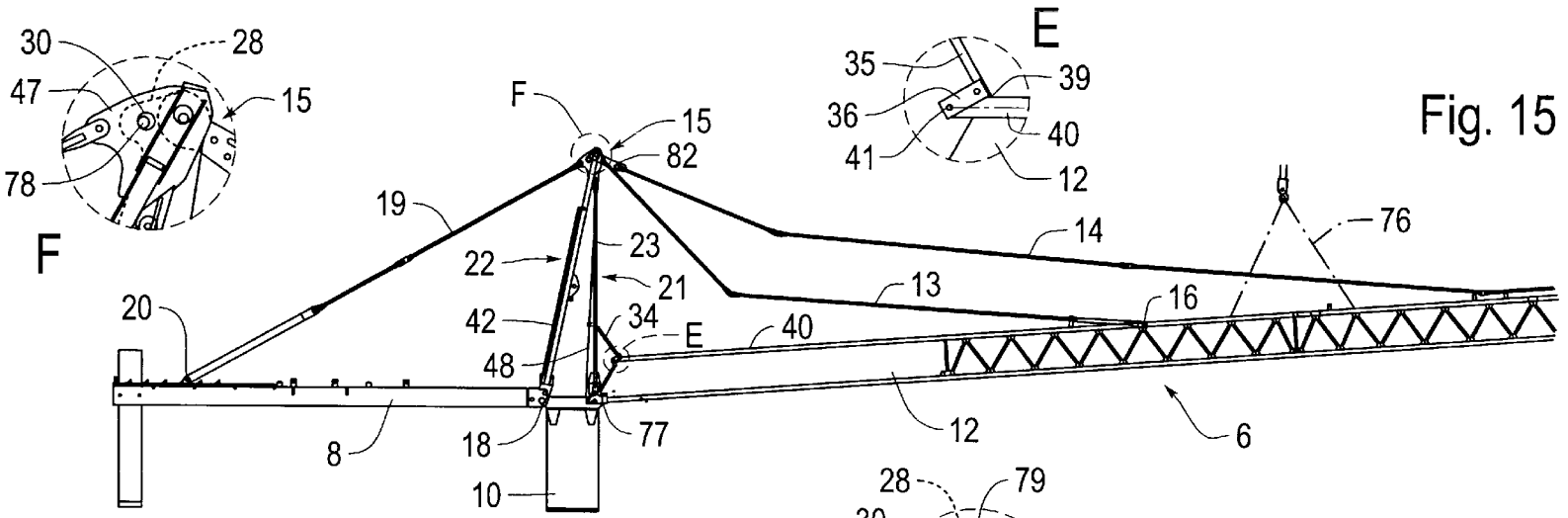
FIG. 15 is a side view illustrating a first step of mounting, on the mast-cab, the assembly formed of the jib, its tie rods and the front part of the jib bearer.

Next, the assembly made up of the jib 6, the jib tie rods 13 and 14 and the front part 21 of the jib bearer 5 is handled, using heavy duty lifting gear, this assembly being lifted up and brought onto the mast-cab 10 in the continuation of the assembly with counterjib 8 previously mounted. This operation is illustrated in FIG. 15, in which the slings used with the lifting gear are shown as 76. During the operation, as shown by detail E in FIG. 12, the prop 34 remains folded. The two tie rods 13 and 14 remain slack.

The posterior end of the jib root 12 and the base of the front part 21 of the jib bearer 5 are then pinned to the mast-cab 10 along a horizontal axis 77.

The lifting-gear is then used to pivot the jib 6 slightly upward about the pin 77 that pins it to the mast-cab 10 (the position visible in FIG. 15), the front part 21 of the jib bearer 5 then correspondingly pivoting backward. The upper tang 28 of the front part 21 of the jib bearer 5 thus engages in the upper yoke 47 of the rear part 22 of this jib bearer 5. As shown by detail F in FIG. 15, the tang 28 and the yoke 47 are then approximately pinned, with play, using a pin 78 which passes through the posterior hole 30 in the tang and the corresponding drillings in the yoke 47, the diameter of the hole 30 being greater than that of the pin 78.

Figure 16:
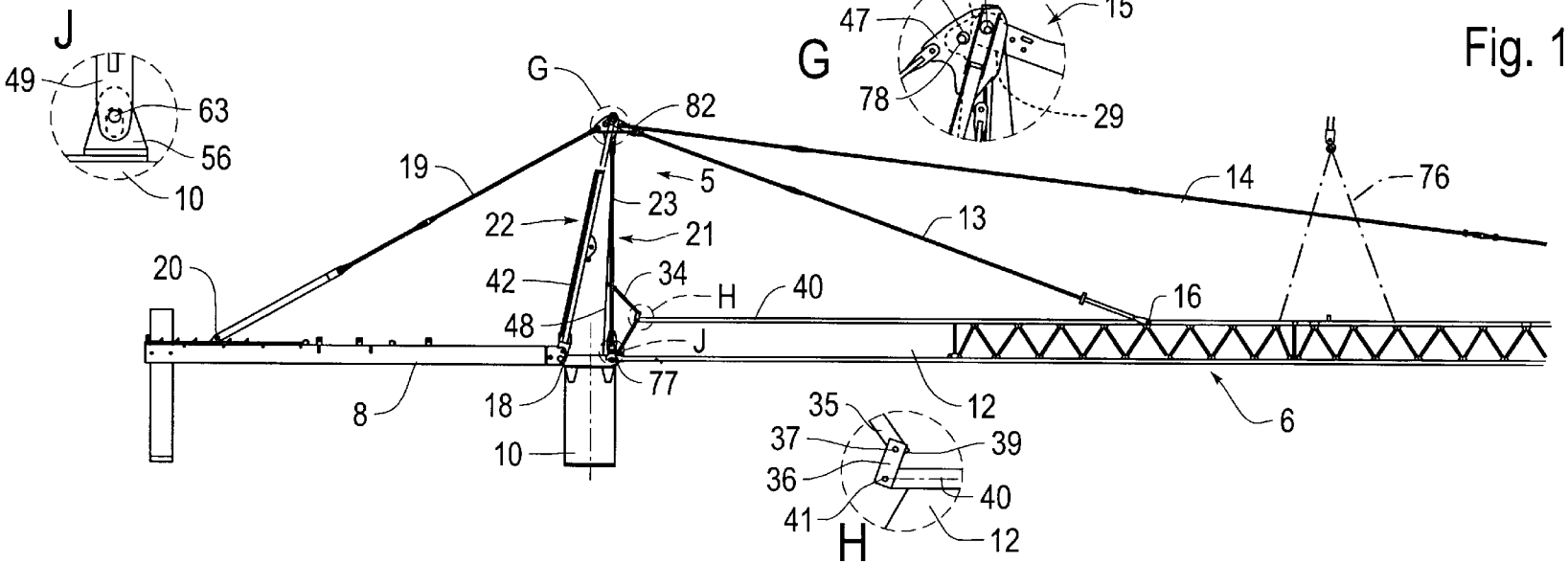
FIGS. 16 and 17 are side views similar to FIG. 5, illustrating two later steps in mounting said assembly on the mast-cab.

In the next step, illustrated by FIG. 16, jib 6 is lowered and returned to roughly horizontal, by pivoting in the opposite direction about the pin 77 that pins it to the mast-cab 10, using the lifting gear. The rear part 22 of the jib bearer 5 is made to move forward by the approximate pinning performed previously, the top of this rear part 22 describing an arc of a circle centered on the axis 18, while the top of the front part 21 of the jib bearer 5 travels along an arc of a circle centered on the axis 77, the movement continuing until the anterior hole 29 of the tang 28 is aligned with the corresponding drillings in the yoke 47, at the point of intersection of the two aforementioned arcs of circles. At the same time, the tie rods 13 and 14 of the jib 6 become aligned and become taut, while the prop 34 unfolds (see detail H in FIG. 16).

Definitive pinning is then performed, connecting the tops of the front part 21 and rear part 22 of the jib bearer 5 together, and to the double link rod 82 linking the tie rods 13 and 14, by inserting a pin 79 through the anterior hole 29 in the tang 28 and the corresponding drillings in the yoke 47—see detail G in FIG. 16, and FIG. 5. The jib bearer 5 then constitutes a rigid structure of triangular shape, the three sides of which are formed, respectively, by the top of the mast-cab-10, the front part 21 (particularly the uprights 23) and the rear part 22 (particularly the uprights 42).

A small platform 80 with a guard rail, borne by the rear part 22 of the jib bearer 5, allows those involved to perform the aforementioned pinning operations connecting the respective tops of the front part 21 and rear part 22 of the jib bearer 5 in complete safety.

It will be noted that once the pin 79 has been used to perform definitive pinning, connecting the tops of the front part 21 and rear part 22 of the jib bearer 5, the retaining link rods 48 are unloaded, the pin 63 moving to an intermediate point along the length of each slot 64—see detail J in FIG. 16.

Figure 17:
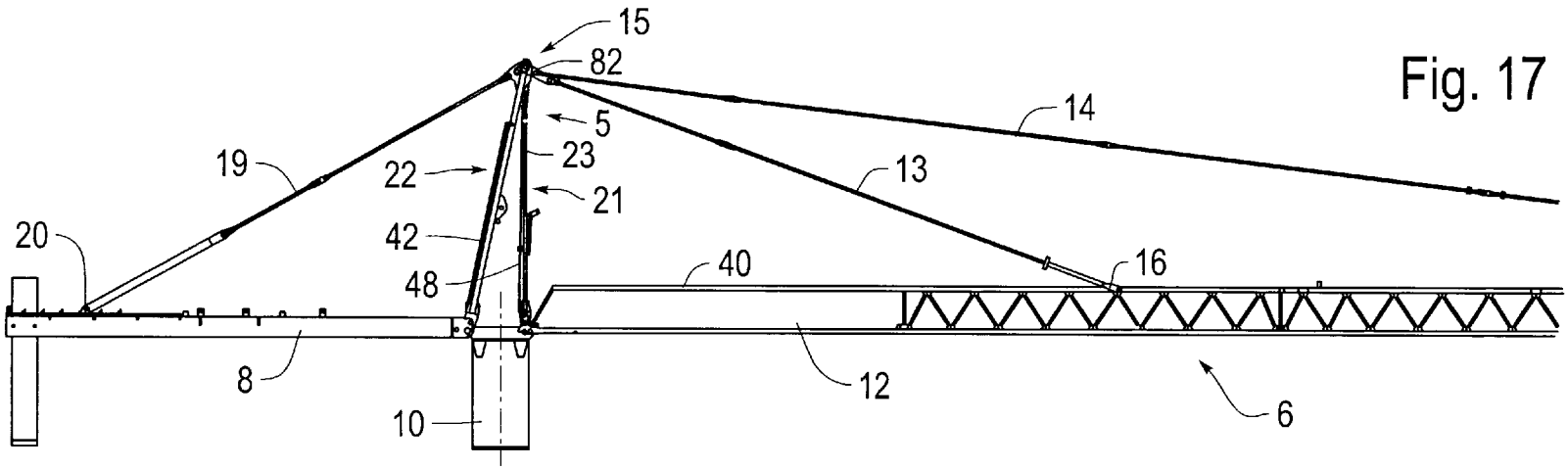

The slings 76 can now be detached from the jib 6, the latter being kept in a roughly horizontal position simply by the tie rods 13 and 14 stretching between the top 15 of the jib bearer 5 and the points 16 axed 17—see FIG. 17.

Figure 18:
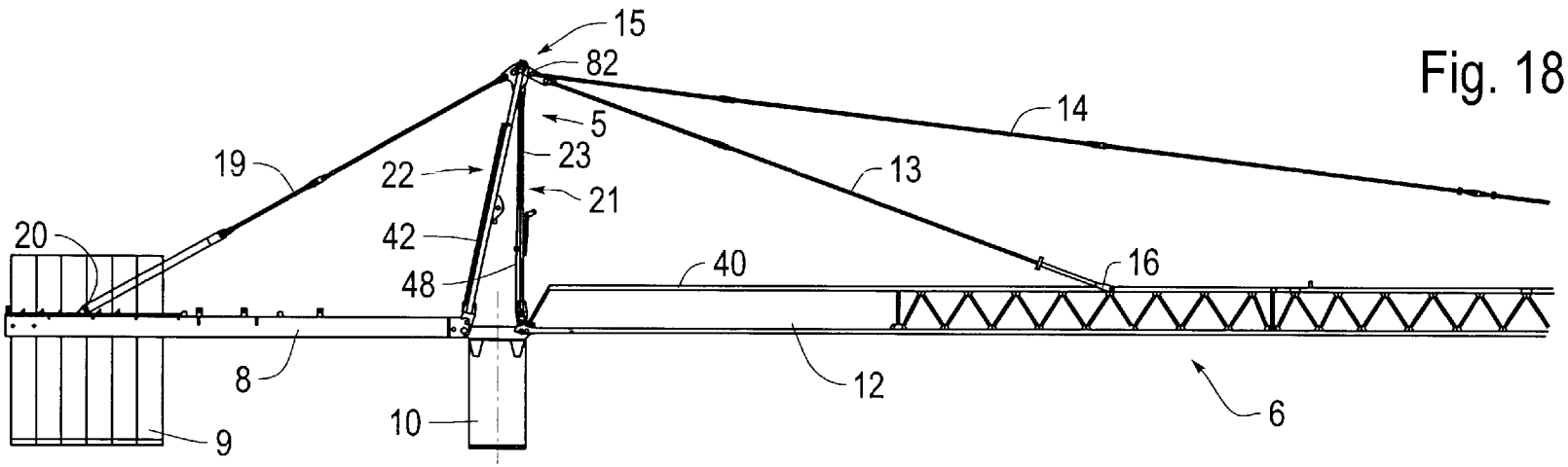
FIG. 18 is a view similar to the previous ones, showing the final step of mounting the revolving part of the crane.
Figure 19:
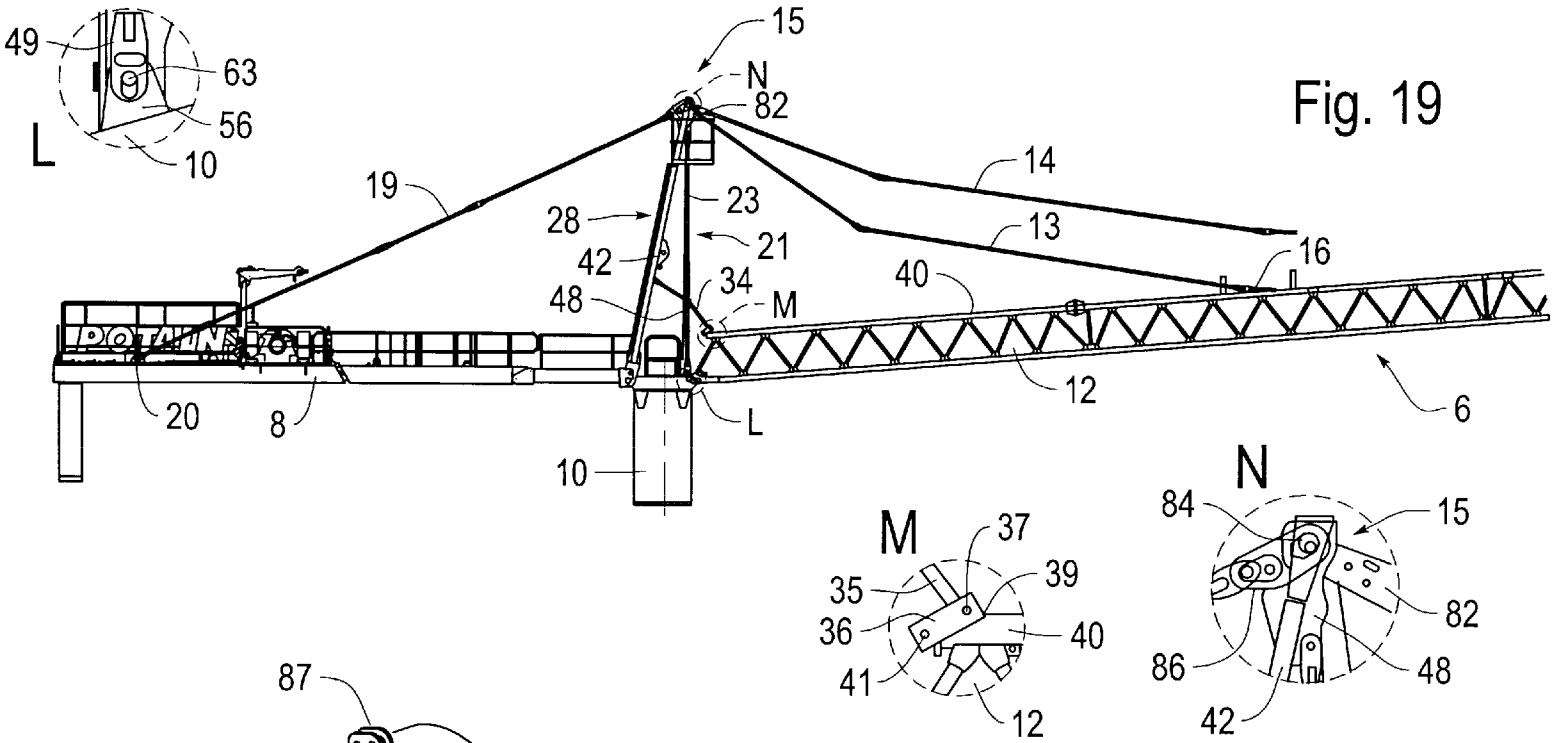
FIG. 19 is a side view illustrating a mounting step, in an alternative form of the invention.
Figure 20:
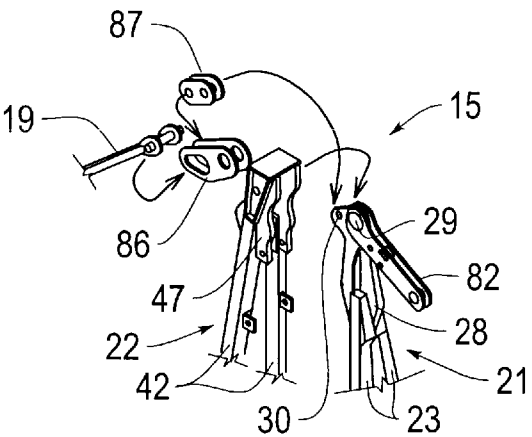
FIG. 20 is a view in exploded perspective of the region of the top of the jib bearer, relating to this alternative form.
Figure 21:
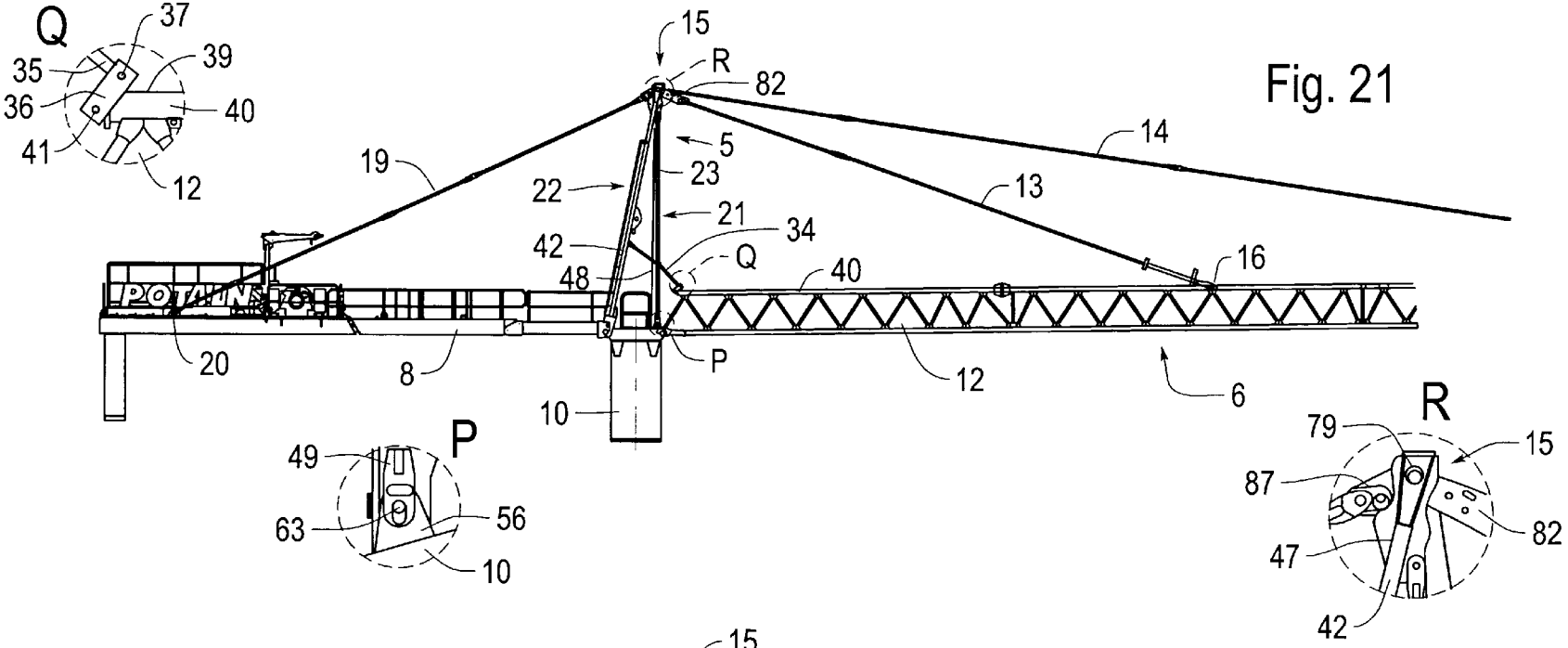
FIGS. 21 and 22 are side views similar to FIG. 19, illustrating later steps in mounting, for the same alternative form.

Finally, using the lifting gear which is now released for use, the counterjib 8 is weighted, by offering up the blocks which form the counterweight 9 to the rear of the structure of this counterjib 8 and securing them thereto—see FIG. 18. The crane is now ready to enter service.

Optionally, as illustrated in FIGS. 15 to 17, one or more blocks which make up the counterweight 9 may already be fitted to the counterjib 8 during the intermediate steps of assembling the crane.

FIGS. 19 to 22 illustrate, as an alternative to what has just been described, another version of the pinning of the upper part of the jib bearer 5. This alternative form employs the following means, clearly visible in FIG. 20 and in details N and R:

The front part 21 of the jib bearer 5 comprises, at its top, a tang 28 with a rear hole 30 for pinning the line of tie rods 19 of the counterjib 8, and a front hole 29 for the definitive pinning of the two parts, namely the front part 21 and the rear part 22, of the jib bearer 5.

The rear part 22 of the jib bearer 5 has, at its top, a yoke 47 with a hole 84 for the definitive pinning of the two parts 21 and 22 of the jib bearer 5. The yoke 47 also has, externally, lateral washers 85 which are coaxial with the aforementioned hole 84; these washers 85, welded to the yoke 47, have an inside diameter equal to that of the pin used for definitive pinning.

The line of tie rods 19 of the counterjib 8 comprises, at its anterior end, two mounting link rods 86 and 87. The first link rod 86 is a double link rod made up of two symmetric plates, which makes the link between the end of the line of tie rods 19 and the lateral washers 85 borne by the top yoke 47 of the rear part 22 of the jib bearer 5. The second link rod 87, particularly in the form of a yoke, is housed inside the double link rod 86 and is connected to the end of the line of tie rods 19 at the same point as the first link rod 86. The distance between centers of the second link rod 87 is slightly shorter, for example by 2 mm, than that of the double link rod 86.

The counterjib 8 is pinned by connecting the double link rod 19 to the upper end of the rear part 22 of the jib bearer 5, using the first link rod (double link rod) 86, the second link rod 87 standing by.

The jib 6 is pinned by connecting the triangulation of this jib, at its upper end and more particularly the rear hole 30 of the tang 28, to the end of the double tie rod 19 of the counterjib 8, using the second link rod 87.

These pinning operations are performed with the jib 6 in the position shown is FIG. 18 (the jib pivoted upward slightly) in a similar way to the way already illustrated in FIG. 15.

In the next step (FIG. 20), the jib 6 is lowered and the tie rods 13 and 14 of the jib 6 are tensioned. At the same time, the line of tie rods 19 of the counterjib 8 is made to move forward by the second link rod 87 and the rear part 22 of the jib bearer 5, held by the first link rod 86, is made to move forward under its own weight. The relative movement between the rear part 22 and the front part 21 of the jib bearer 5 which then occurs, approximately corresponds to the difference between the distances between centers of the first link rod 86 and of the second link rod 87 and this allows the respective holes 29 and 84 for the definitive pinning of the two parts 21 and 22 of the jib bearer to come into perfect alignment while the tie rods are being tensioned.

The tops of the front part 21 and rear part 22 of the jib bearer 5 are then definitively pinned together by inserting a pin 79 through the previously aligned holes—see detail R in FIG. 27. The retaining link rods 48 are then unloaded, as is the prop 34—compare details L and M of FIG. 19 respectively with details P and Q in FIG. 21.

Figure 22:
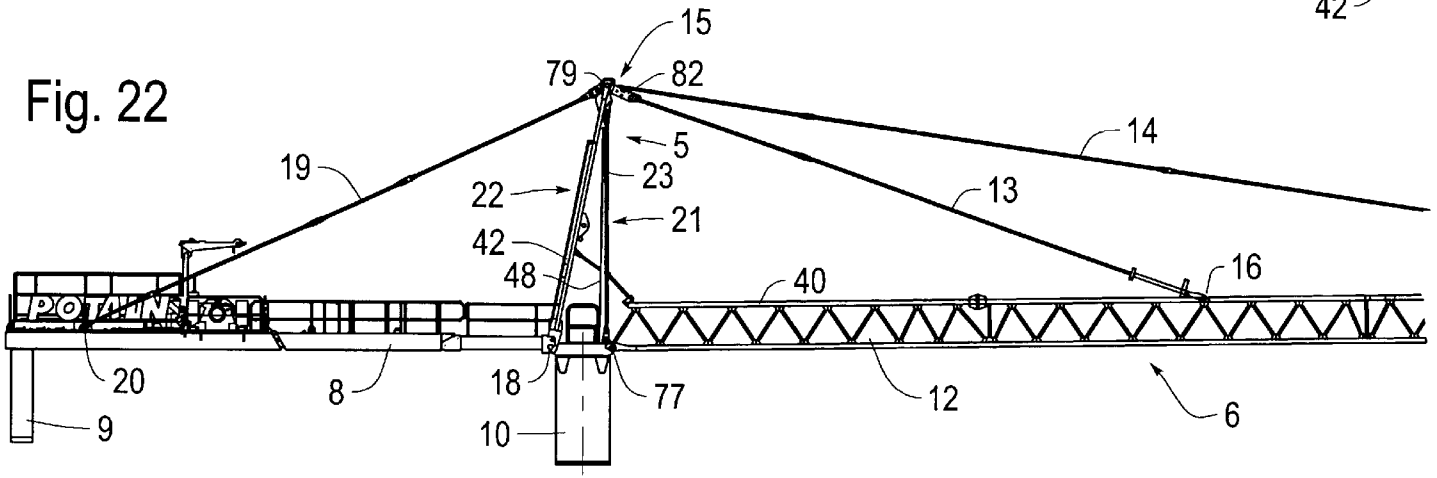

Finally, the slings 76 can be detached from the jib 6, held only by the taut tie rods 13 and 14, this final step being shown in FIG. 22.

This alternative form has as its advantage over the version described previously, that the distances between centers of the holes at the tops of the front part 21 and rear part 22 of the jib bearer 5 need no longer be produced very accurately, thus getting around a dimensional constraint.

The revolving part 4 of the crane can be dismantled using a series of operations which are the opposite of those previously described, by first of all separating the two parts 21 and 22 of the jib bearer 5, then by handling, on the one hand, the assembly made up of the jib 6, the front part 21 of the jib bearer 5, and the tie rods 13 and 14 and, on the other hand, the assembly made up of the counterjib 8, the rear part 22 of the jib bearer 5 and the double tie rod 19. Once separated, the two parts 21 and 22 of the jib bearer 5 are of minimal size for transport and storage.

It would not be departing from the scope of the invention as defined in the claims:

- to modify the order of operations for prebuilding on the ground the assembly with the jib and the assembly with the counterjib, or even to have these operations performed simultaneously for the two assemblies;
- to apply the same method, with necessary adaptations, to cranes with jibs and/or counterjibs which have tie rods of a different number than the one considered in the examples previously described and illustrated in the drawing;
- to produce the jib bearer, still by joining a front part and a rear part which are separable, but with the shape of a four-sided polygon, such as a rectangle or trapezium, instead of triangular shape (when viewed from the side);
- to modify the construction of the two parts of the jib bearer, or one of them, it being possible for the front or rear part of the jib bearer to be produced in the form of a single upright, instead of a two-upright latticework structure.

What is claimed is:

1. A method for mounting a revolving part, the revolving part comprising a jib bearer, a delivery jib which is articulated by its posterior end to a front face of the jib bearer and connected to a top of the jib bearer by one or more anterior tie rods, and a counterjib which is articulated by its anterior end to a rear face of the jib bearer and connected to the top of the jib bearer by one or more posterior tie rods, the method comprising the steps of:

assembling a first assembly formed by the counterjib, the posterior tie rod or rods and a rear part of the jib bearer, the first assembly connected along a horizontal axis on a revolving pivot or a mast-cab element connected to the revolving pivot;

assembling a second assembly formed by the delivery jib, the anterior tie rod or rods and a front part of the jib bearer, the second assembly connected along a horizontal axis on a revolving pivot or a mast-cab;

lifting the first assembly;

lifting the second assembly; and connecting respective tops of the front part and the rear part of the jib bearer together, wherein the lifting of the first assembly is performed using slings comprising front slings secured to a base of the rear part of the jib bearer and passing over a deflecting member borne by the rear part, and rear slings secured to the structure of the counterjib to keep the structure of the counterjib approximately horizontal while the first assembly is being lifted and pinned to the revolving pivot or the mast-cab, the posterior tie rod or rods of the counterjib being aligned and taut.

2. The method as claimed in claim 1, wherein the second assembly is assembled by connecting a base of the front part of the jib bearer in an articulated manner to the posterior end of a jib root and by also connecting the front part of the jib bearer to the jib root by a means which restricts the forward and backward pivoting of the front part of the jib bearer with respect to the delivery jib.

3. The method as claimed in claim 2, wherein the angle between the two limit positions of the front part of the jib bearer is approximately 5°.

4. The method as claimed in claim 1, wherein the second assembly comprises, for each tie rod of the delivery jib, attaching a rear part of the tie rod to the top of the front part of the jib bearer, attaching a front part of that same tie rod to an intermediate point of the delivery jib, bringing the rear part and the front part of the tie rod closer together using a sling pulled by auxiliary handling or lifting gear, and pinning a front end of the rear part of a tie rod to a rear end of the front part of the tie rod.

5. The method as claimed in claim 1, which further comprises, after the operation of pinning the first assembly comprising the counterjib and the rear part of the jib bearer to the revolving pivot or the mast-cab element, making a temporary connection, with play, to hold the rear part of the jib bearer in an upright position while waiting for the top of the front part of the jib bearer to be pinned to a top of the rear part.

6. A method for mounting a revolving part, the revolving part comprising a jib bearer, a delivery jib which is articulated by its posterior end to a front face of the jib bearer and connected to a top of the jib bearer by one or more anterior tie rods, and a counterjib which is articulated by its anterior end to a rear face of the jib bearer and connected to the top of the jib bearer by one or more posterior tie rods, the method comprising the steps of:

assembling a first assembly formed by the counterjib, the posterior tie rod or rods and a rear part of the jib bearer, the first assembly connected along a horizontal axis on a revolving pivot or a mast-cab element connected to the revolving pivot;

assembling a second assembly formed by the delivery jib, the anterior tie rod or rods and a front part of the jib bearer, the second assembly connected along a horizontal axis on a revolving pivot or a mast-cab;

lifting the first assembly;

lifting the second assembly; and connecting respective tops of the front part and the rear part of the jib bearer together, wherein the lifting of the first assembly is performed using slings comprising front slings secured to a base of the rear part of the jib bearer, but which are not deflected in any way, and rear slings secured to the structure of the counterjib, the slings being of an appropriate length to keep the structure of the counterjib in an inclined position with respect to the horizontal while the first assembly is being lifted and pinned to the revolving pivot or the mast-cab, the rear part of the jib bearer being pivoted backward in such a way that the posterior tie rod or rods remain slack, and wherein, after the first assembly has been pinned to the revolving pivot or the mast-cab, the structure of the counterjib is returned to the horizontal and the tie rod or rods are tensioned.

7. The method as claimed in claim 6, wherein the structure of the counterjib forms, with respect to the horizontal, an angle equal to or greater than 15°, while the first assembly is being lifted up and pinned.

8. A method for mounting a revolving part, the revolving part comprising a jib bearer, a delivery jib which is articulated by its posterior end to a front face of the jib bearer and connected to a top of the jib bearer by one or more anterior tie rods, and a counterjib which is articulated by its anterior end to a rear face of the jib bearer and connected to the top of the jib bearer by one or more posterior tie rods, the method comprising the steps of:

assembling a first assembly formed by the counterjib, the posterior tie rod or rods and a rear part of the jib bearer, the first assembly connected along a horizontal axis on a revolving pivot or a mast-cab element connected to the revolving pivot;

assembling a second assembly formed by the delivery jib, the anterior tie rod or rods and a front part of the jib bearer, the second assembly connected along a horizontal axis on a revolving pivot or a mast-cab;

lifting the first assembly;

lifting the second assembly; and connecting respective tops of the front part and the rear part of the jib bearer together, wherein, after the posterior tie rod or rods of the counterjib have been pretensioned by tilting the rear part of the jib bearer forward, the first assembly is lifted up using slings comprising front slings and rear slings secured to the structure of the counterjib to keep the structure and the counterjib roughly horizontal, or at least slightly inclined to the horizontal, while the first assembly is being lifted and pinned.

9. The method as claimed in claim 8, wherein the structure of the counterjib forms, with respect to the horizontal, an angle of approximately 6° while the first assembly is being lifted and pinned.

10. A method for mounting a revolving part, the revolving part comprising a jib bearer, a delivery jib which is articulated by its posterior end to a front face of the jib bearer and connected to a top of the jib bearer by one or more anterior tie rods, and a counterjib which is articulated by its anterior end to a rear face of the jib bearer and connected to the top of the jib bearer by one or more posterior tie rods, the method comprising the steps of:

assembling a first assembly formed by the counterjib, the posterior tie rod or rods and a rear part of the jib bearer, the first assembly connected along a horizontal axis on a revolving pivot or a mast-cab element connected to the revolving pivot;

assembling a second assembly formed by the delivery jib, the anterior tie rod or rods and a front part of the jib bearer, the second assembly connected along a horizontal axis on a revolving pivot or a mast-cab;

lifting the first assembly;

lifting the second assembly; and connecting respective tops of the front part and the rear part of the jib bearer together, wherein the lifting of the second assembly is performed using slings, keeping the delivery jib approximately horizontal until such time as it is pinned to the revolving pivot or the mast-cab, then by pivoting the jib upward slightly about a pin used for this pinning to approximately pin, with play, the top of the front part to the top of the rear part of the jib bearer.

11. The method as claimed in claim 10, wherein, after carrying out the approximate pinning, the delivery jib is pivoted in the opposite direction, bringing the rear part of the jib bearer forward and performing a definitive pinning operation to stiffen the jib bearer, the definitive pinning operation being performed at the point of intersection of an arc of a circle centered on the axis of pinning of the counterjib to the revolving pivot or the mast-cab, along which the hole for the definitive pinning of the top of the rear part of the jib bearer travels and another arc of a circle centered on an axis of pinning of the jib to the revolving pivot or the mast-cab, along which the hole for the definitive pinning of the top of the front part of the jib bearer travels.

* * * * *